US007801468B2

(12) United States Patent
Shimomura

(10) Patent No.: US 7,801,468 B2
(45) Date of Patent: Sep. 21, 2010

(54) TONER CARTRIDGE AND MECHANISM FOR OPENING AND CLOSING A TONER DISCHARGING OPENING

(75) Inventor: Tatsuhiko Shimomura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 985 days.

(21) Appl. No.: 11/423,031

(22) Filed: Jun. 8, 2006

(65) Prior Publication Data

US 2006/0280526 A1 Dec. 14, 2006

(30) Foreign Application Priority Data

Jun. 9, 2005 (JP) ..... 2005-16942

(51) Int. Cl.
*G03G 15/08* (2006.01)

(52) U.S. Cl. ..... 399/260; 399/258

(58) Field of Classification Search ..... 399/103, 399/119, 120, 258, 260, 263
See application file for complete search history.

(56) References Cited

U.S. PATENT DOCUMENTS 5,608,501 A * 3/1997 Makino ..... 399/119
5,956,546 A * 9/1999 Tsuchiya ..... 399/119
6,324,371 B1 * 11/2001 Okiyama et al. ..... 399/262
2004/0091288 A1 * 5/2004 Yahagi ..... 399/258
2006/0104671 A1 * 5/2006 Murakami et al. ..... 399/258
2007/0212118 A1 * 9/2007 Nagae et al. ..... 399/260

FOREIGN PATENT DOCUMENTS

JP 11-084838 A 3/1999

* cited by examiner

*Primary Examiner*—David M Gray
*Assistant Examiner*—Billy J Lactaoen
(74) *Attorney, Agent, or Firm*—Panitch Schwarze Belisario & Nadel LLP

(57) ABSTRACT

A toner cartridge and a developing unit are used in an image forming apparatus. The toner cartridge includes a toner chamber, an inner shutter, and an outer shutter. The toner chamber holds toner therein and has an opening through which the toner is discharged into the developing unit. The inner shutter is disposed in the toner chamber and is rotatable relative to the toner chamber to close and open the opening. The outer shutter has an engagement portion, is mounted to an outer surface of the toner chamber, and is movable either to a closing position where said outer shutter closes the opening or to an opening position where the outer shutter opens the opening. When the toner cartridge is moved into the developing unit, the engagement portion is guided in a guide groove formed in the developing unit to move relative to the toner chamber from the closing position to the opening position.

8 Claims, 14 Drawing Sheets

TONER CARTRIDGE AND MECHANISM FOR OPENING AND CLOSING A TONER DISCHARGING OPENING

BACKGROUND OF THE INVENTION

Field of the Invention

The resent invention relates to a toner cartridge and a developing unit to which the toner cartridge is attached.

Electrophotographic printers and copying machines that use toner commonly employ a replaceable developing unit. This type of developing unit is designed such that a toner cartridge is replaced upon exhaustion of toner. With this type of conventional developing unit, when toner is nearing exhaustion, a toner cartridge must be replaced for replenishing the toner. Thus, the developing unit is designed such that the toner cartridge is detachably mounted.

Among the toner cartridges is one disclosed in Japanese Patent (KOKAI) No. 11-84838. This toner cartridge includes a body having a toner-discharging opening through which toner is discharged, and a toner chamber accommodated in the body. The toner chamber also has an opening that can be aligned with the opening formed in the body by rotating the toner chamber relative to the body. The toner cartridge is placed on the developing unit such that the toner-discharging opening of the body is aligned with an opening formed in a casing of the developing unit. Then, the toner chamber is rotated until the opening in the toner chamber is aligned with the opening in the casing for discharging the toner into the developing unit.

In order to dismount the toner cartridge from the developing unit, the toner chamber is first rotated in the reverse direction until the opening in the toner chamber has moved completely out of alignment with the toner-discharging opening in the body, thereby closing the toner-discharging opening from inside of the body. Then, the toner cartridge is dismounted from the developing unit.

However, closing the toner-discharging opening from inside of the toner cartridge leaves some of the toner adhering to the perimeters of the toner-discharging opening. The toner may fall onto the surroundings within the apparatus and/or adhere to the operators clothes.

SUMMARY OF THE INVENTION

An object of the invention is to provide a toner cartridge in which when the toner cartridge is dismounted, the toner will not fall from the toner cartridge, and a mounting-and-dismounting mechanism for the toner cartridge.

A toner cartridge and a developing unit are used in an image forming apparatus. The toner cartridge includes a toner chamber, an inner shutter, and an outer shutter. The toner chamber holds toner therein and having an opening through which the toner is discharged from the toner chamber into the developing unit. The inner shutter is disposed in the toner chamber and is rotatable relative to the toner chamber to close and open the opening from inside of the toner chamber. The outer shutter has an engagement portion and is movably mounted to an outer surface of the toner chamber. The outer shutter is movable either to a closing position where the outer shutter closes the opening or to an opening position where the outer shutter opens the opening. The developing unit includes a guide groove. The guide groove is formed in the developing unit. When the toner cartridge is moved into the developing unit, the guide groove engages the engagement portion to guide the engagement portion in the guide groove in such a way that the outer shutter moves relative to the toner chamber from the closing position to the opening position.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Embodiments of the present invention will be described with reference to the accompanying drawings.

First Embodiment

Figure 1:
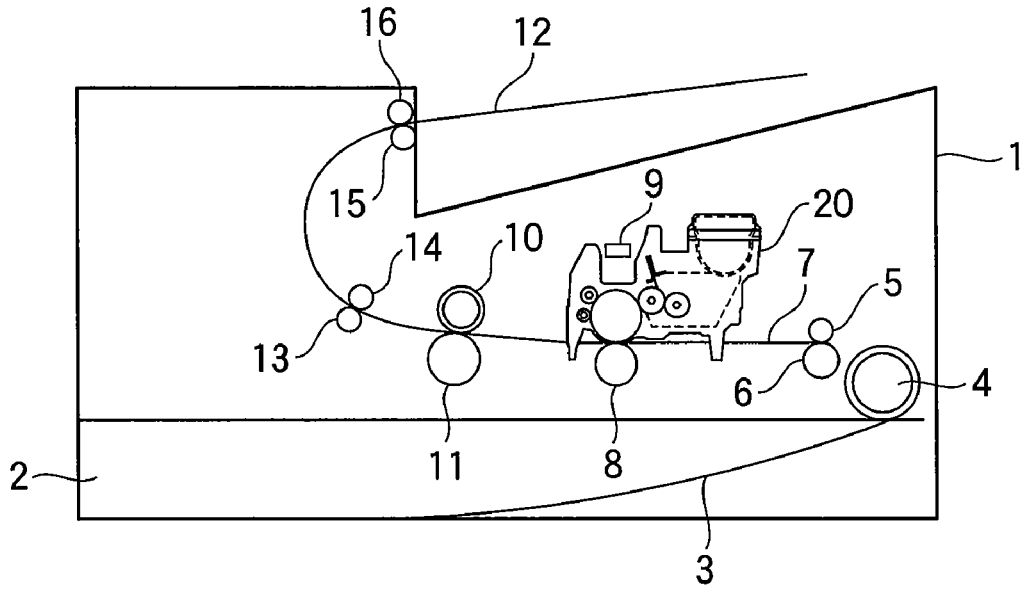
FIG. 1 is a side view illustrating an outline of an image forming apparatus to which the present invention is applied.
Figure 2:
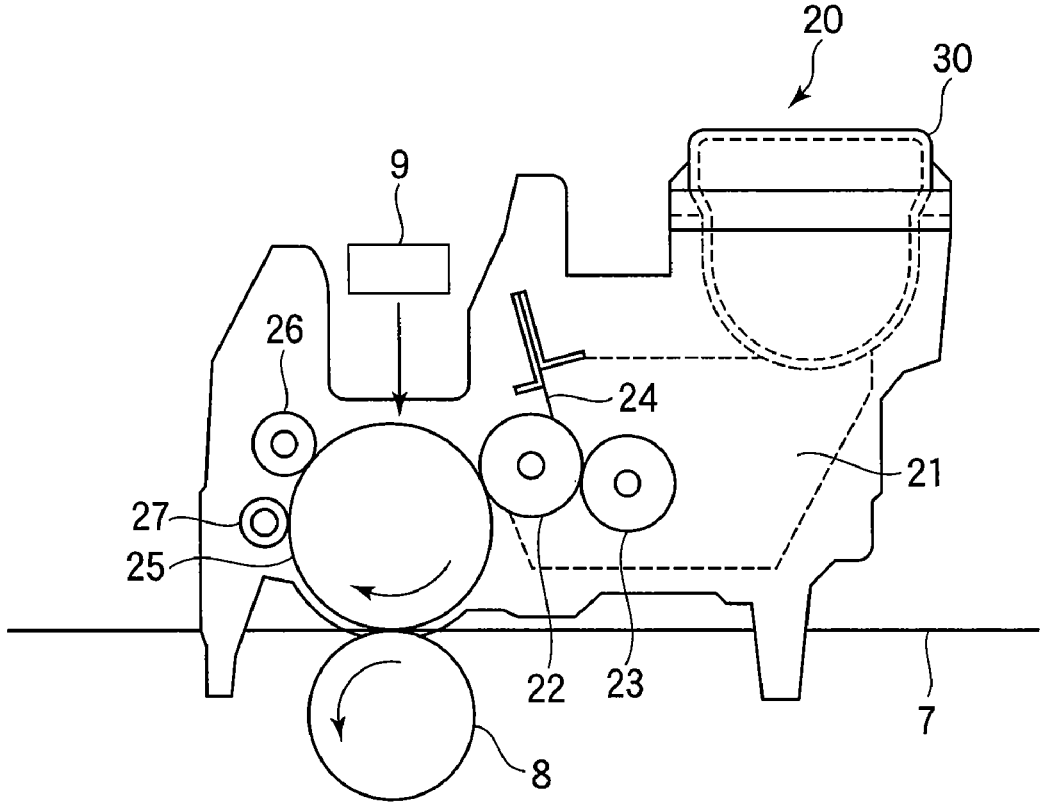
FIG. 2 illustrates the outline of a developing unit.

FIG. 1 is a side view illustrating an outline of an image forming apparatus to which the present invention is applied. A cassette 2 holds a stack of recording medium 3 in it. A hopping roller 4 feeds the recording medium 3 on a page-by-page basis. A registration roller 6 and a pinch roller 5 are disposed downstream of the hopping roller 4. The registration roller 6 and pinch roller 5 cooperate with each other to feed the recording medium 3 into a transfer point defined between a transfer roller 8 and a photoconductive drum 25 (FIG. 2). A developing unit 20 is disposed above the transfer roller 8. A heat roller 10 and a pressure roller 11 are disposed downstream of the transfer roller 8. Discharge rollers 13-16 are disposed downstream of the heat roller 10, and transport the recording medium 3 after fixing.

FIG. 2 illustrates the outline of the developing unit 20. A toner cartridge 30 is detachably attached to the developing unit 20. A toner reservoir 21 holds toner in it. A toner-supplying roller 23 supplies the toner to a developing roller 22. A blade 24 forms a thin layer of toner on the surface of the developing roller 22. A charging roller 26 charges the surface of the photoconductive drum 25 uniformly. An exposing unit 9 illuminates the charged surface of the photoconductive drum 25 in accordance with print data, thereby forming an electrostatic latent image on the photoconductive drum 25. The developing roller 22 supplies the toner to the electrostatic latent image to develop the electrostatic latent image into a toner image. The toner image is then transferred onto the recording medium 3. A cleaning roller 27 removes residual toner from the photoconductive drum 25.

The toner cartridge 30 is detachably attached to the developing unit 20, and supplies the toner into the toner reservoir 21.

Figure 3A:
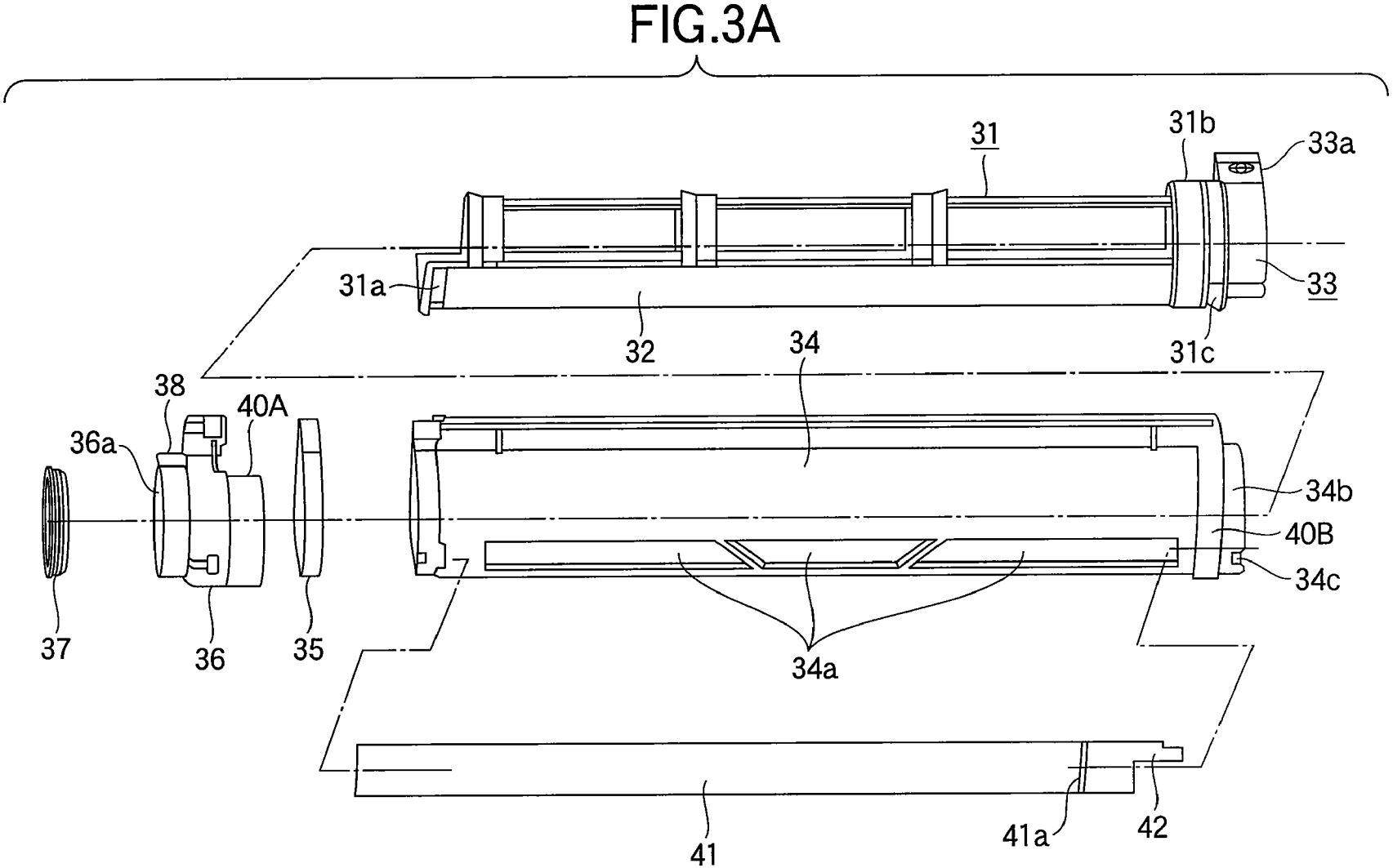
FIG. 3A is an exploded perspective view of a toner cartridge.

FIG. 3A is an exploded perspective view of the toner cartridge 30.

Figure 3B:
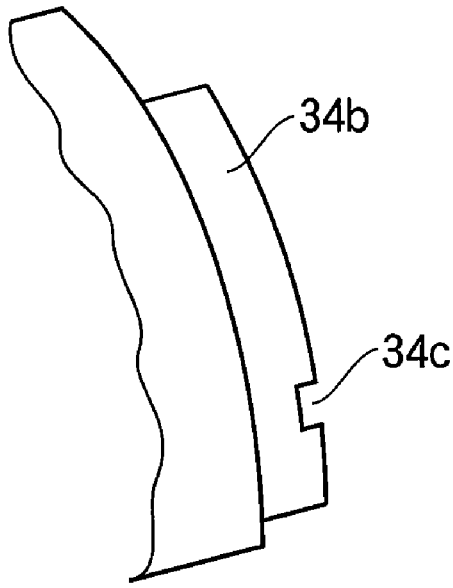
FIG. 3B is a fragmentary perspective view illustrating a cutout formed in the toner cartridge.
Figure 3C:
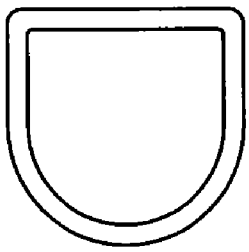
FIG. 3C illustrates a sealing member 35.

FIG. 3B is a fragmentary perspective view illustrating a cutout formed in the toner cartridge;

FIG. 3C illustrates a sealing member 35.

Figure 3D:
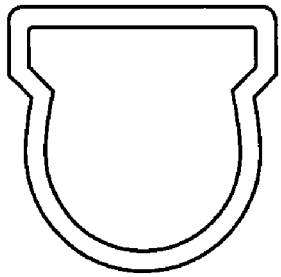
FIG. 3D illustrates the sealing member 35 when it is mounted.

FIG. 3D illustrates the sealing member 35 when it is mounted.

Figure 4:
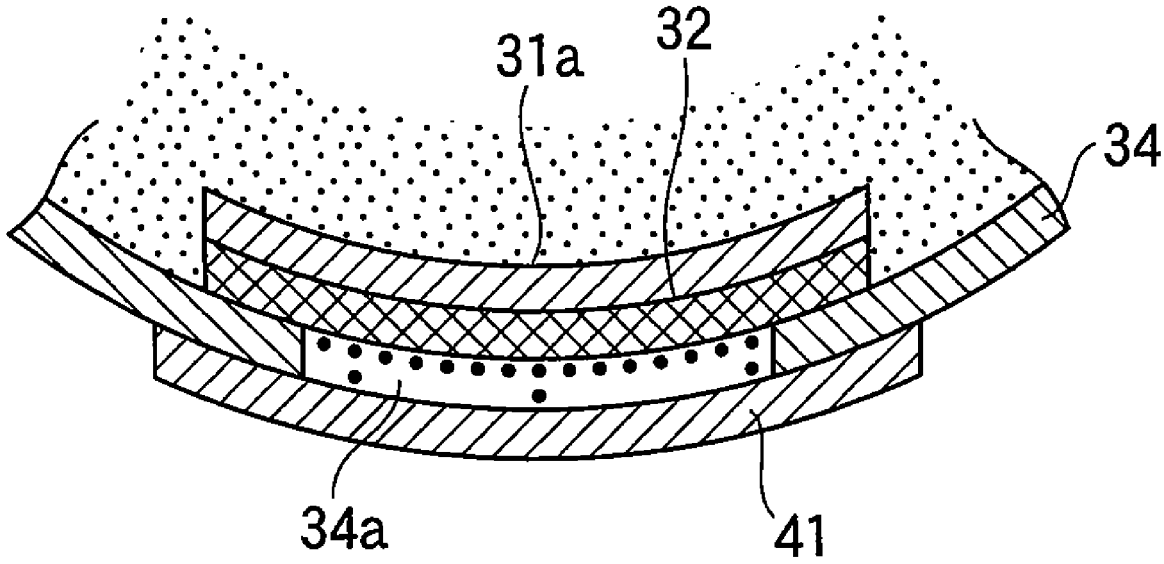
FIG. 4 is a fragmentary cross-sectional view of the toner cartridge, illustrating an outer shutter, an outer body, a resilient sealing member, and a circumferential wall.

FIG. 4 is a fragmentary cross-sectional view of the toner cartridge 30, illustrating an outer shutter 41, an outer body 34, a resilient sealing member 32, and a circumferential wall 31*a*.

Figure 8A:
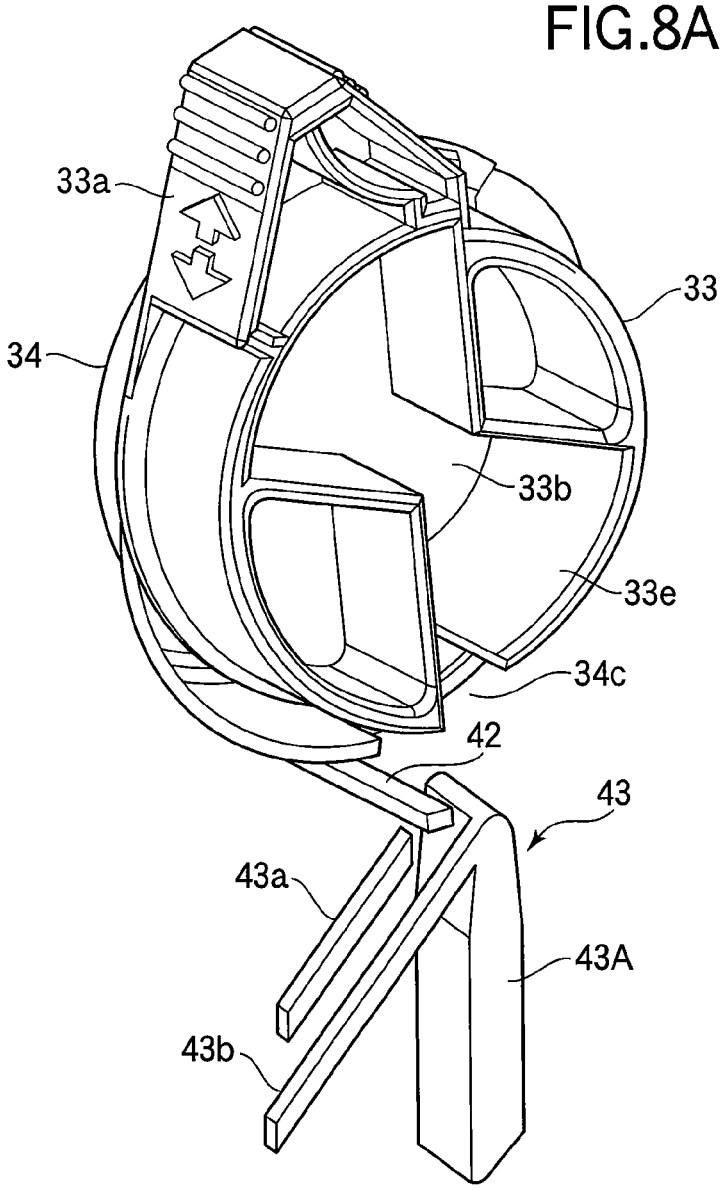
FIG. 8A is a perspective view illustrating the positional relation between the toner cartridge and guide bars.
Figure 9A:
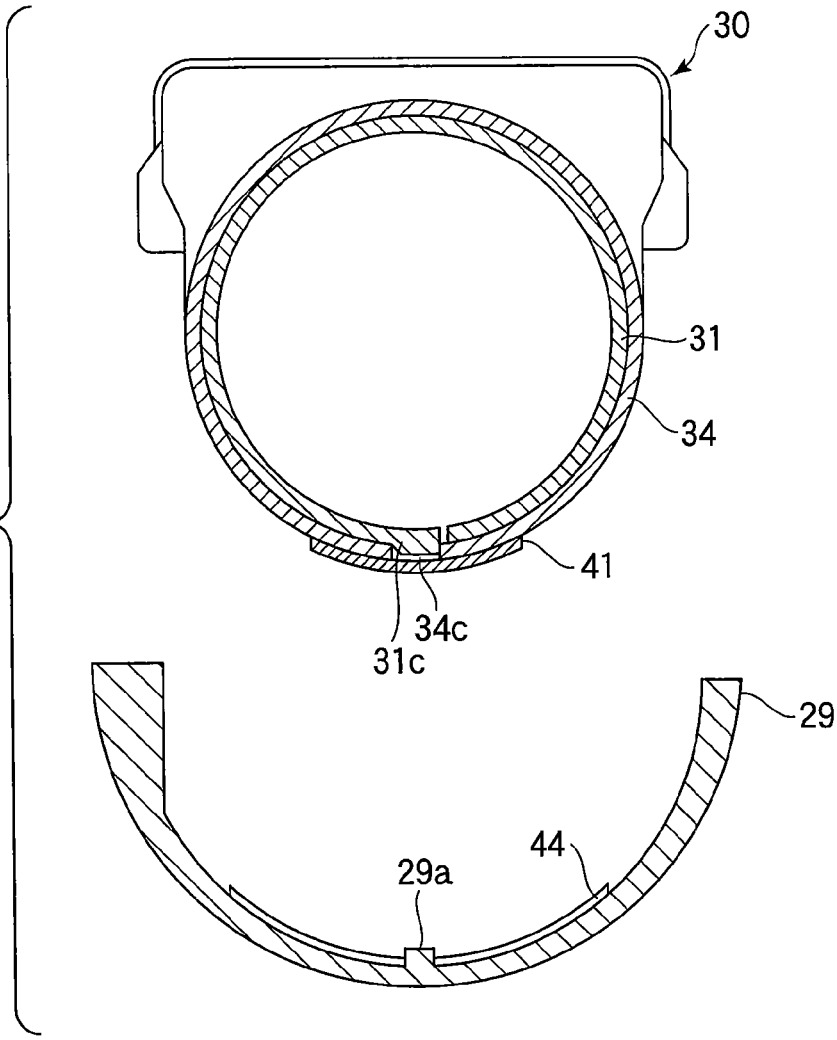
FIGS. 9A and 9B illustrate the locking operation of the inner shutter and the outer body.

Referring to FIG. 3A, an inner shutter 31 includes the circumferential wall 31*a* and an operation portion 33. The circumferential wall 31*a* extends parallel to its longitudinal direction along a cylindrical inner surface of the outer body 34, and is covered with the sealing member 32. The operation portion 33 is formed at one longitudinal end of the inner shutter 31, and has a substantially disc-shaped wall 33*b* (FIG. 8A) normal to the longitudinal direction of the inner shutter 31. A sealing portion 31*b* is essentially concentric to the disc-shaped wall 33*b*, and is formed on an outer circumferential surface of the disc-shaped wall 33*b*. The operation portion 33 also has a radially extending lever 33*a*. A U-shaped hole is formed in a circumferential wall of the inner shutter 31 between the sealing portion 31*b* and the radially extending lever 33*a*, thereby defining a resilient strap having a short projection 31*c* that radially outwardly extends into a cutout 34*c* so that when the short projection 31*c* is received in the cutout 34*c*, the inner shutter 31 is locked to the outer shutter 41 (FIG. 9A).

When the inner shutter 31 has been fitted into the outer body 34 through one longitudinal end 34*b*, the sealing portion 31*b* provides a seal between the inner shutter 31 and the outer body 34. The outer body 34 is formed with a plurality of openings 34*a* aligned along a longitudinal direction of the outer body 34. The toner in the toner cartridge 30 is discharged through the openings 34*a*. The outer body 34 has the cutout 34*c* formed in its one longitudinal end portion. The cutout 34*c* receives the projection 31*c* in it when the shutter 31 has been assembled into the outer body 34, so that the inner shutter 31 is accurately positioned relative to the outer body 34 and is prevented from rotating relative to the outer body 34. When the inner shutter 31 is accurately positioned relative to the outer body 34, the circumferential wall 31*a* completely closes the openings 34*a* from inside of the outer body 34.

An attachment 36 fits over another longitudinal end portion of the outer body 34 remote from the longitudinal end 34*b*. The attachment 36 fits over the outer body 34 with a sealing member 35 sandwiched between the attachment 36 and the outer body 34. As shown in FIG. 3C, the sealing member 35 is loop-shaped before it is assembled to the outer body 34. As shown in FIG. 3D, the sealing member is deformed to configure the contour of the outer body 34. After the toner has been introduced into the outer body 34 through an opening 36*a* formed in the attachment 36, a cap 37 is screwed into the attachment 36 to completely close the opening 36*a*. The attachment 36 has an engagement portion 38 on its circumferential surface. When the outer body 34 is attached to the developing unit 20, the engagement portion 38 enters under engagement portions 28 (FIG. 7) so that the engagement portions 28 hold the engagement portion 38.

Figure 5A:
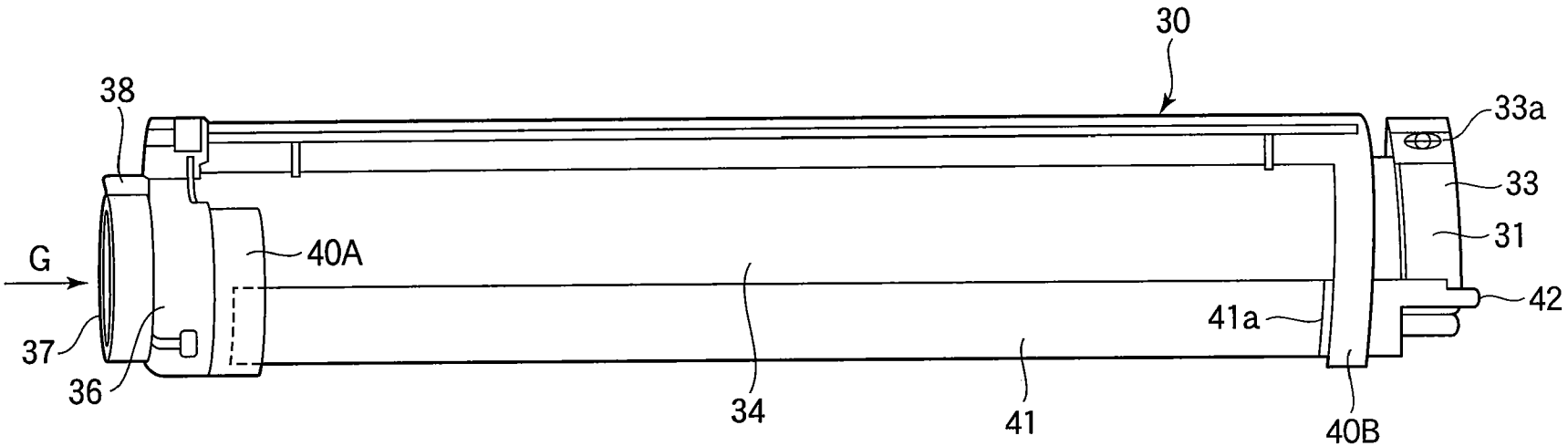
FIG. 5A is a perspective view of the toner cartridge as seen in a direction shown by arrow F in FIG. 5B.
Figure 5B:
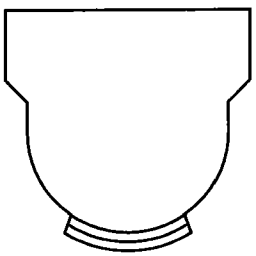
FIG. 5B is a side view of the toner cartridge as seen in a direction shown by arrow G in FIG. 5A.

FIG. 5A is a perspective view of the toner cartridge 30 as seen in a direction shown by arrow F in FIG. 5B.

FIG. 5B is a side view of the toner cartridge as seen in a direction shown by arrow G in FIG. 5A.

Figure 5C:
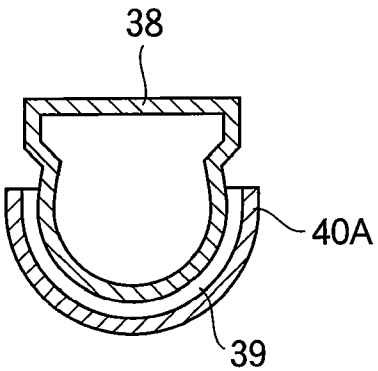
FIG. 5C illustrates a side of the attachment 36 as seen in a direction opposite to the direction shown by arrow G.

FIG. 5C illustrates a side of the attachment 36 as seen in a direction opposite to the direction shown by arrow G.

Referring to FIG. 5A, an arch 40B (FIG. 11) has a larger diameter than the outer body 34 and is formed in one piece with the outer body 34. The arch 40B extends over and along the outer circumferential surface of the outer body 34, defining a predetermined gap h1 between the arch 40B and the outer circumferential surface. The attachment 36 has a circumferential wall 40A having a larger diameter than the outer body 34. When the attachment 36 fits over the outer body 34, the circumferential wall 40A and the outer surface of the outer body 34 define a circumferential gap h2.

The outer shutter 41 extends along the longitudinally extending outer surface of the outer body 34. The outer shutter 41 has one longitudinal end portion that is loosely received in the circumferential gap h2 defined between the circumferential wall 40A and the outer surface of the outer body 34, and another longitudinal end portion that extends through the gap h1 between the arch 40B and the outer circumferential surface of the outer body 34. The outer shutter 41 is in the shape of an arcuate wall such that the outer shutter 41 is movable along the circumferential outer surface of the outer body 34 in a circumferential direction. Before the outer body 34 is attached to the developing unit 20, the outer shutter 41 is at a closing position where the outer shutter 41 closes the openings 34*a* formed in the outer body 34. The outer shutter 41 includes a stopper 41*a* that abuts a side surface of the arch 40B to prevent the outer shutter 41 from being pulled out in the longitudinal direction of the outer shutter 41 (FIG. 5A).

The outer shutter 41 includes an engagement portion 42 that is in one piece with the outer shutter 41 and projects further than the operation portion 33 in the longitudinal direction of the outer body 34.

{Developing Unit}

Figure 6:
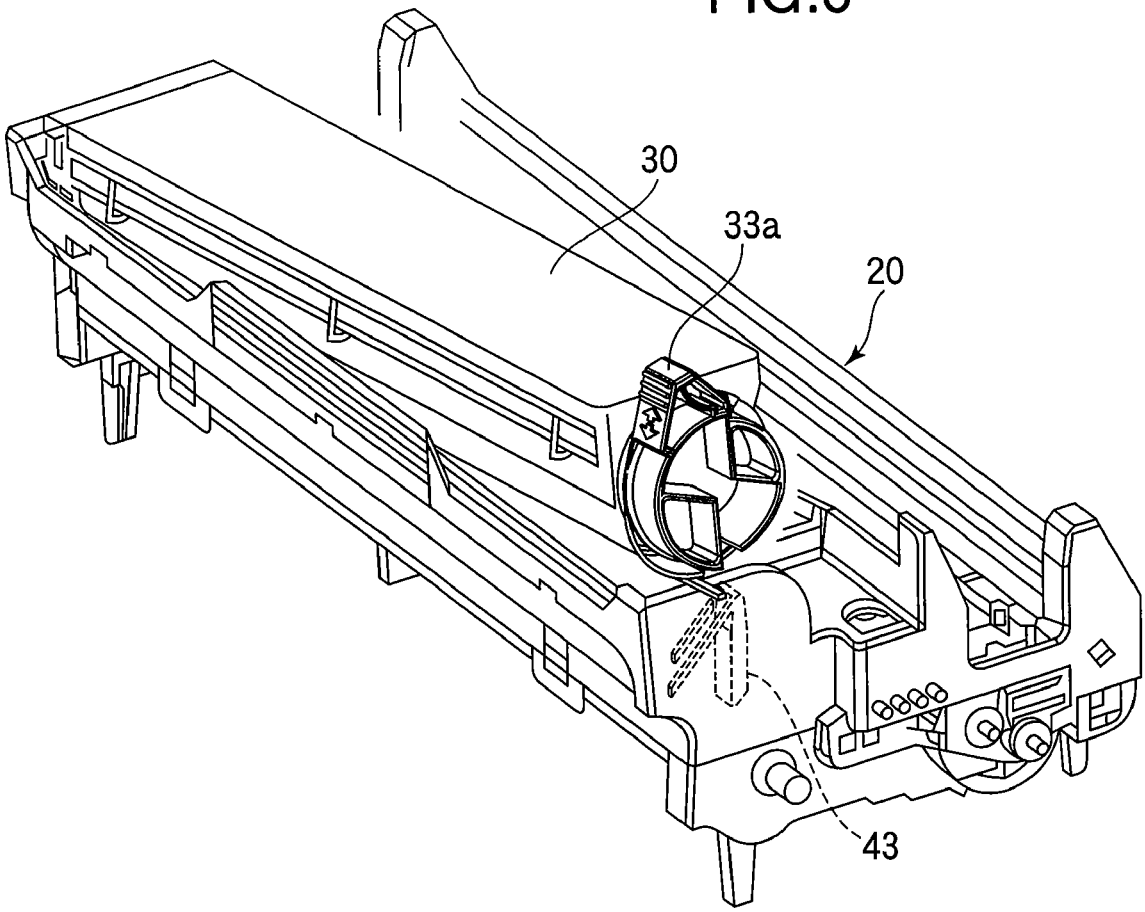
FIG. 6 illustrates the toner cartridge and a developing unit.
Figure 7:
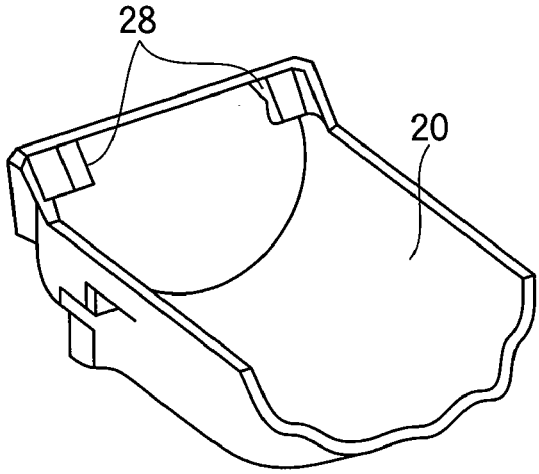
FIG. 7 is a fragmentary perspective view of the developing unit.
Figure 8B:
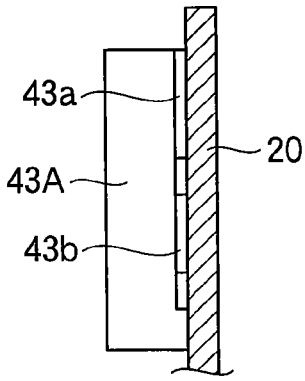
FIG. 8B is a side view of the guide bars and a projection.

FIG. 6 illustrates the toner cartridge 30 and the developing unit 20. FIG. 7 is a fragmentary perspective view of the developing unit 20. FIG. 8A is a perspective view illustrating the positional relation between the toner cartridge 30 and the guide bars 43*a* and 43*b*. FIG. 8B is a side view of the guides 43*a* and 43*b* and the projection 43A.

Referring to FIG. 6, the developing unit 20 includes an engagement portion 43 that is formed on the inner wall of the developing unit 20 at a longitudinal end of the developing unit 20. The engagement portion 43 includes guides 43*a* and 43*b* and a projection 43A. The guide 43*b* extends downwardly from one end of the projection 43A. The guide bar 43*a* extends in parallel to the guide 43*a*.

These guides 43*a* and 43*b* are fixed to the inner vertical wall of the developing unit 20 as shown in FIG. 8B.

When the cartridge 30 is lowered from above the developing unit 20, the guides 43*a* and 43*b* receive the engagement portion 42 between them. As the toner cartridge 30 is lowered into the developing unit 20, the guides 43*a* and 43*b* guide the engagement portion 42 downwardly at an angle with a vertical direction in which the cartridge 30 is lowered into the developing unit 20. As the engagement portion 42 is guided by the guides 43*a* and 43*b*, the engagement portion 42 is driven by the guides 43*a* and 43*b* so that the outer shutter rotates relative to the outer body 34 from a closing position where the outer shutter 41 closes the openings 34*a* to an opening position where the outer shutter 41 opens the openings 34*a*.

Figure 9B:
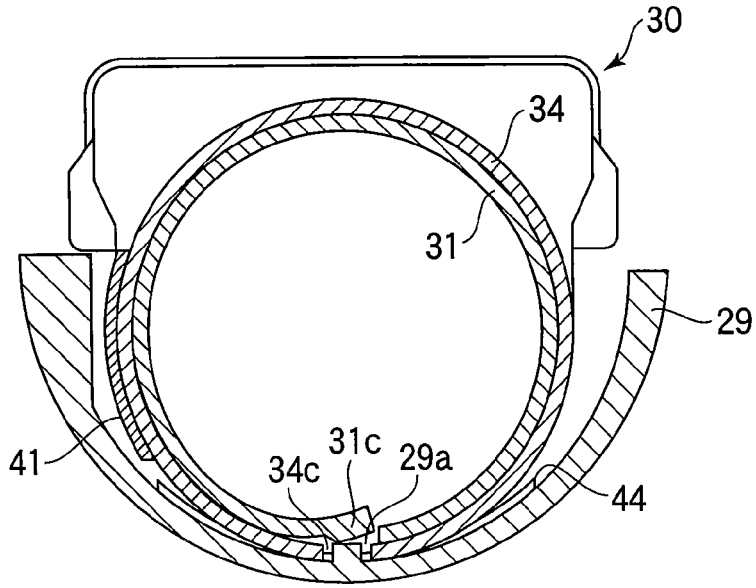

FIGS. 9A and 9B illustrate the locking operation of the inner shutter 31 and the outer body 34.

The developing unit 20 includes a mounting frame 29 that defines a receiving space in the shape of a deformed cylinder that has been partially cut away in a plane parallel to the longitudinal axis. The mounting frame 29 has a projection 29*a* at a bottom of an arcuate wall of the mounting frame 29. The mounting frame 29 has recesses formed in the bottom that receive the attachment 36 and the arch 40B so that the central portion of the toner chamber 34 comfortably sits on the bottom as shown in FIG. 9B. Once the toner cartridge 30 is completely received in the mounting frame 29, the projection 29*a* pushes the projection 31*c* causing the projection 31*c* to inwardly deform. This allows the inner shutter 31 to be rotated in the outer body 34.

The toner is discharged from the toner cartridge 30 into the developing unit 20 through an opening, not shown, formed in the bottom of the mounting frame 29. A resilient sealing member 44 is fixed to the perimeter of this opening.

{Attaching Toner Cartridge To Developing Unit}

The procedure for attaching the toner cartridge 30 to the mounting frame 29 will now be described.

Referring back to FIGS. 5 and 6, an operator tilts the toner cartridge 30 so that the engagement portion 38 (FIG. 5A) of the outer body 34 first engages the engagement portion 25 of the developing unit 20. The one longitudinal end of the outer body 34 is thus received in the mounting frame 29.

FIGS. 10A-10H illustrate the procedure for attaching the toner cartridge 30 to the mounting frame 29.

Figure 10A:
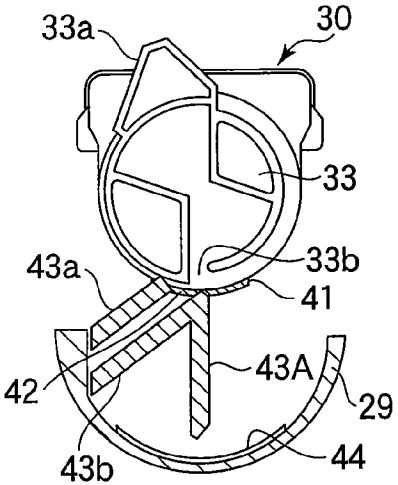
FIGS. 10A-10H illustrate the procedure for attaching the toner cartridge 30 to the mounting frame.
Figure 10B:
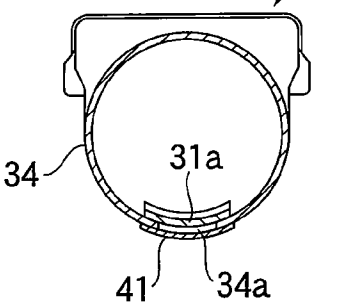

Referring to FIGS. 10A and 10B, after one longitudinal end of the outer body 34 has been received in the mounting frame 29, the operator lowers another longitudinal end portion of the outer body 34 into the mounting frame 29 so that the engagement portion 42 of the outer shutter 41 enters a gap between the guide bars 43*a* and 43*b*. At this moment, the openings 34*a* formed in the outer body 34 are still closed by the circumferential wall 31*a* from inside of the output body 34 and by the outer shutter 41 from outside of the outer body 34.

Figure 10C:
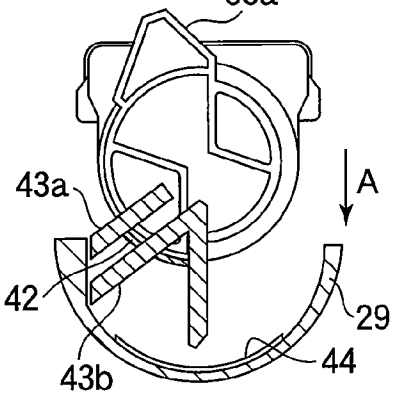
Figure 10D:
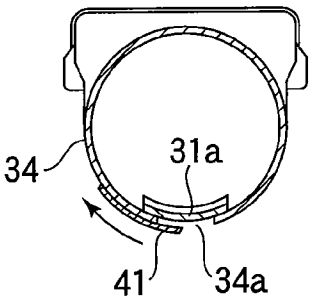

Referring to FIGS. 10C and 10D, the operator lowers another longitudinal end portion of the outer body 34 to gradually depress the toner cartridge 30 downward. As the toner cartridge 30 enters further into the mounting frame 29, the engagement portion 42 moves gradually along the guide bars 43*a* and 43*b* so that the outer shutter 41 slowly rotates about the outer body 34 from the closing position toward the opening position. Because the outer shutter 41 moves away from the closing position, the projection 31*c* of the inner shutter 31 is exposed.

Referring to FIGS. 10C and 10D, the longitudinal end portion of the outer body 34 is further depressed downward in a direction shown by arrow A into the mounting frame 29 until the toner cartridge 30 is completely received into the mounting frame 29. Thus, the outer shutter 41 takes up the opening position.

Once the toner cartridge 30 has been attached in the mounting frame 29, a projection 29*a* pushes the projection 31*c* into the inner space of the outer body 34, thereby causing the projection 31*c* to resiliently move out of the cutout 34*c*. This allows the inner shutter 31 to rotate relative to the outer body 34.

Figure 10E:
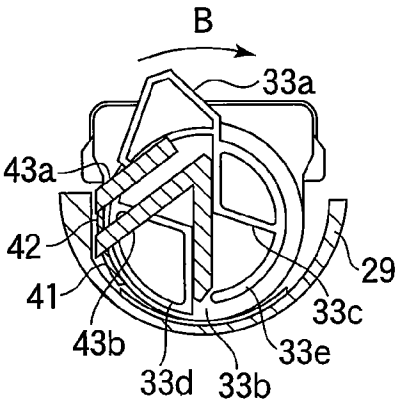
Figure 10F:
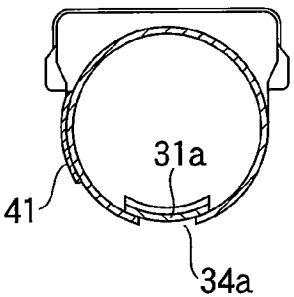

Referring to FIGS. 10E and 10F, when the operator rotates the lever 33*a* of the operation portion 33 in a direction shown by arrow B, the inner shutter 31 rotates to cause the circumferential 31*a* to open the openings 34*a*. As a result, the toner is discharged through the openings 34*a* from the toner cartridge 30 into the developing unit 20.

Figure 10G:
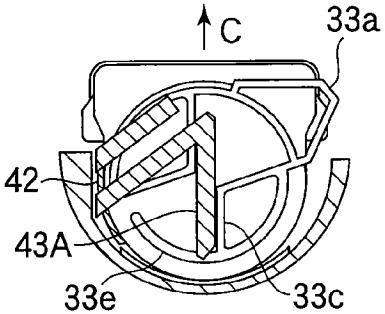
Figure 10H:
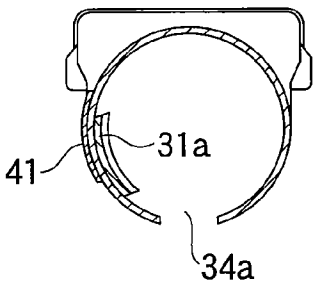

As shown in FIGS. 10G and 10H, when the toner cartridge 30 is attached to the mounting frame 29, the projection 43A of the engagement portion 43 enters the operation portion 33 through a cutout 33*b* and then a gap between a rib 33*c* and a rib 33*d*. When the operator rotates the lever 33*a*, the rib 33*c* abuts the projection 43A, thereby restricting further rotation of the inner shutter 31. At this moment, an arcuate portion 33*e* of the rib 33*c* is under a lower end of the projection 43A, so that the arcuate portion 33*e* prevents the operator from pulling the toner cartridge 30 out of the mounting frame 29 in a direction shown by arrow C. In this manner, when the openings 34*a* remain open, the toner cartridge is prevented from being dismounted.

When the operator takes the toner cartridge 30 out of the mounting frame 29, the operator rotates the lever 33*a* in the opposite direction to the closing position in FIGS. 10E and 10D. The rotation of the lever 33*a* causes the inner shutter 31 to rotate to the closing position, so that the arcuate wall 31*a* closes the openings 34*a* from inside of the outer body 34 and the arcuate portion 33*e* of the rib 33*c* is no longer under a lower end of the projection 43A. The toner cartridge 30 can then be lifted from the mounting frame 29. At this moment, some toner may have deposited to the surface of the circumferential wall 31*a* and the sealing member 32 and the perimeter portion of the openings 34*a*.

After having rotated the lever 33*a* completely in the direction opposite to the arrow B in FIG. 10E, the operator slowly lifts the toner cartridge 30 upward from the mounting frame 29. The engagement portion 42 is guided by the guides 43*a* and 43*b* along the guides 43*a* and 43*b* generally upwardly, while slowly rotating backward about the outer body 34 so that the outer shutter 41 moves to the closing position in FIGS. 10A and 10B. In this manner, the outer shutter 41 again closes the openings 34*a* from outside of the outer body 34, thereby preventing the toner adhering to the perimeters of the openings 34*a* from falling from the outer body 34.

According to the first embodiment, two guides 43*a* and 43*b* guide the engagement portion 42, thereby allowing the outer shutter 41 to move between the closing position and the opening position. This simple, inexpensive structure reliably prevents the toner from falling from the toner cartridge 30.

Second Embodiment

Figure 11:
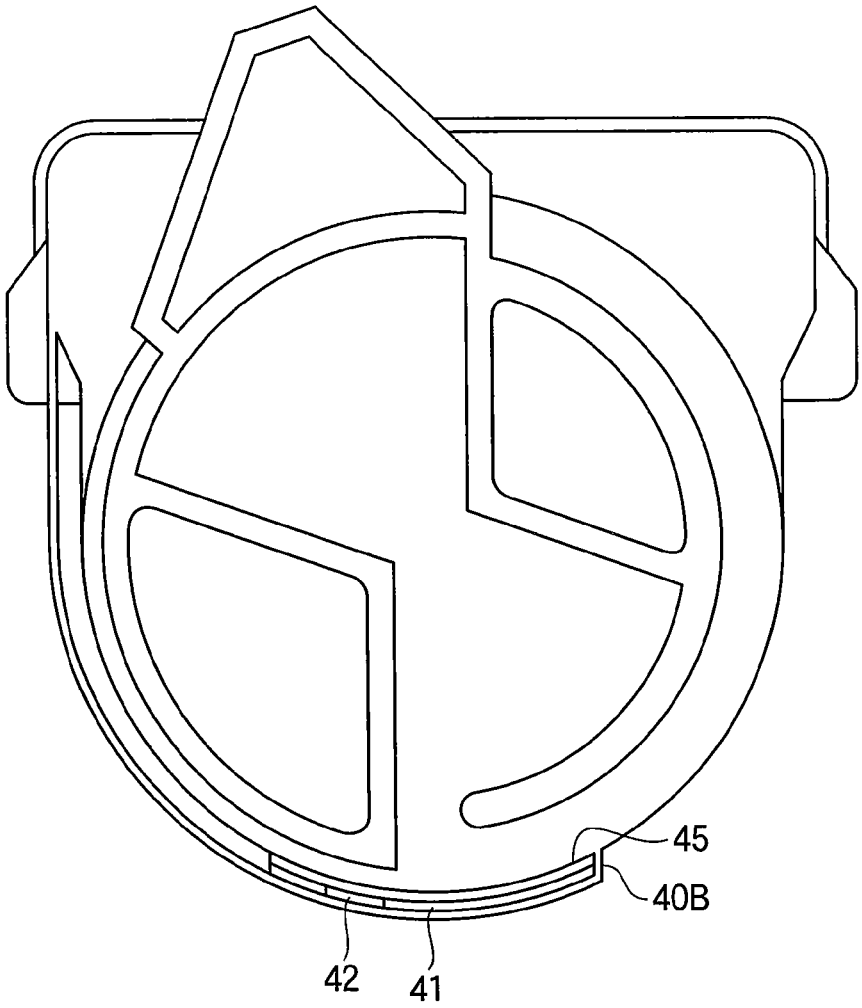
FIG. 11 illustrates a toner cartridge according to a second embodiment.

FIG. 11 illustrates a toner cartridge 30 according to a second embodiment.

Figure 12:
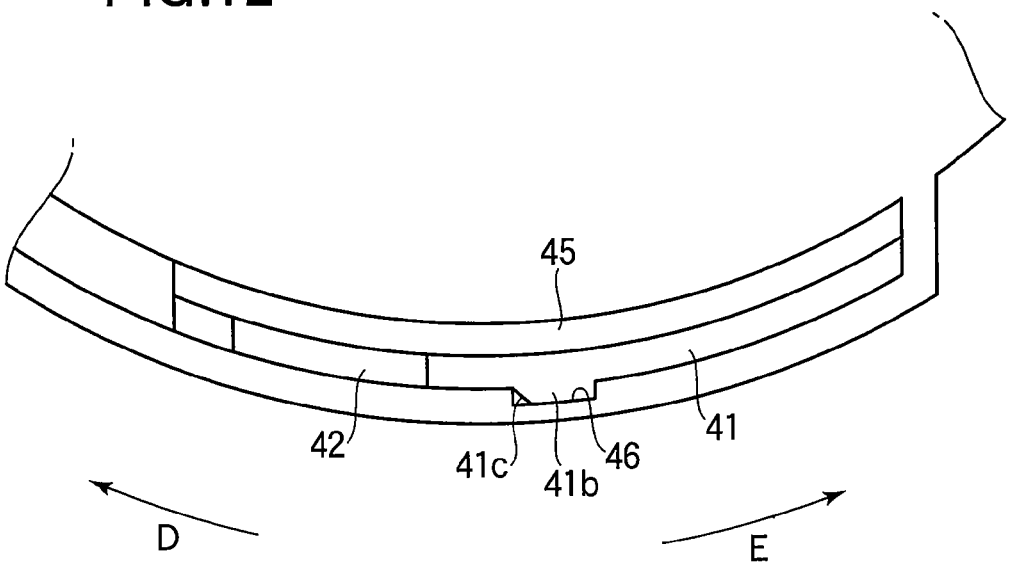
FIG. 12 is an enlarged side view of the toner cartridge.

FIG. 12 is an enlarged side view of the toner cartridge 30.

A toner cartridge according to the second embodiment has the same configuration as the toner cartridge according to the first embodiment in FIGS. 5, 8A, and 8B except for the outer shutter 41 and the arch 40B. The outer shutter 41 has a projection 41*b* that engages an arch 40B and a sealing member 45 is sandwiched between the outer shutter 41 and a circumferential surface of the outer body 34. The surface of the sealing member 45 is coated with a resin having a small frictional coefficient (e.g., fluoroplastics).

Figure 13:
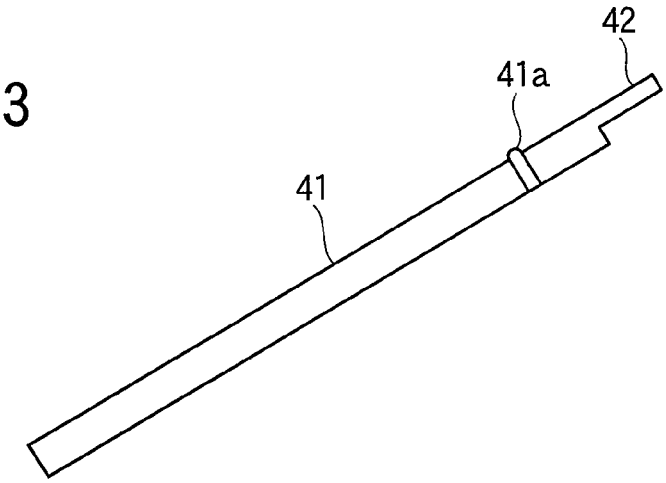
FIGS. 13-15 are perspective views illustrating an outer shutter and a sealing member.
Figure 14:
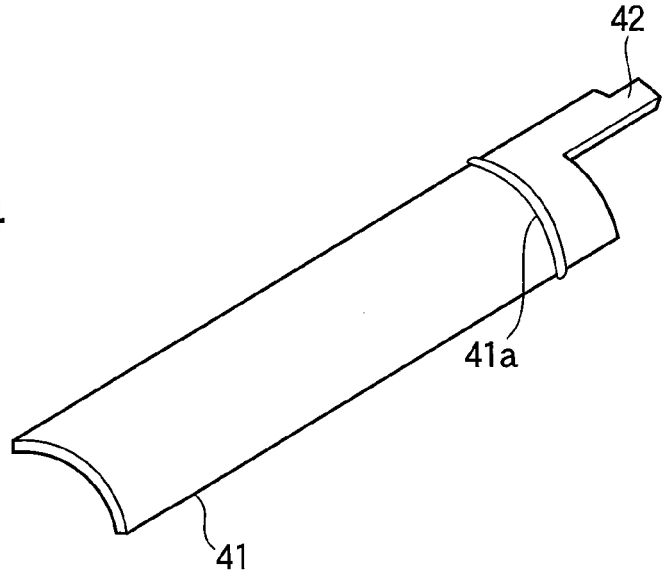
Figure 15:
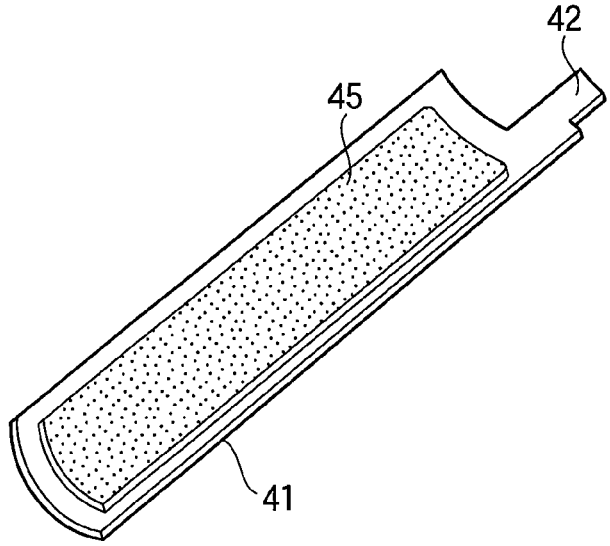
Figure 16:
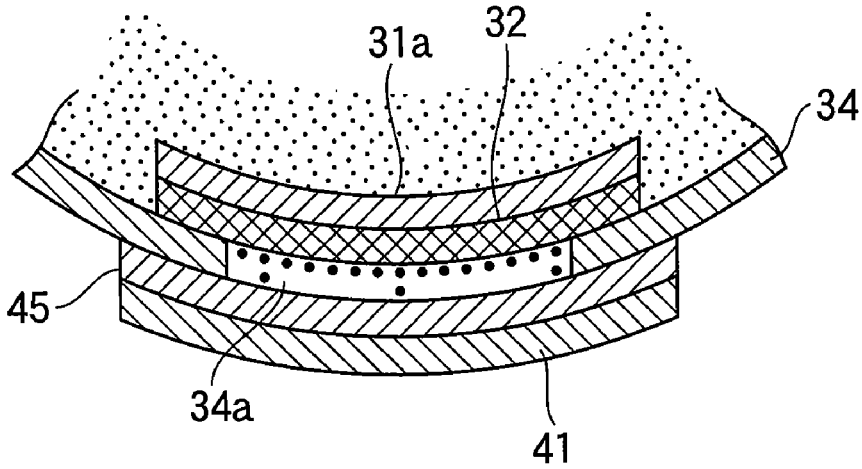
FIG. 16 is a cross-sectional view illustrating the positional relation among the outer shutter, a resilient sealing member, an outer body, a resilient sealing member, and an inner shutter.

FIGS. 13-15 are perspective views, illustrating the outer shutter 41 and the sealing member 45. FIG. 16 is a cross-sectional view illustrating the positional relation among the outer shutter 41, the resilient sealing member 45, the outer body 34, a resilient sealing member 32, and the inner shutter 31*a*.

The sealing member 45 is formed of a foamed urethane sponge material, and is fixed to an inner surface of the outer shutter 41. An engagement projection 41*b* is formed on an outer surface of the outer shutter 41, and has a beveled surface 41*c* so that when the outer shutter 41 is moved in a direction shown by arrow D, the engagement projection 41*b* can move out of a recess 46 without difficulty. When the outer shutter is moved in a direction shown by arrow E, the engagement projection 41*b* abuts the surface of the recess 46. A circumferential wall 40A is of the same construction as the circumferential wall 40A in the first embodiment. When the outer shutter 41 is at a closing position where the outer shutter 41 closes an opening 34*a* formed in the outer body 34, the projection 41*b* is received in the recess 46.

Therefore, for example, even if the toner cartridge 30 receives large vibrations during transportation or a large impact when it is dropped inadvertently, the outer shutter 41 may be reliably held at the closing position. Thus, even if a projection 31*c* disengages from the inner shutter 31 during transportation and therefore the inner shutter 31 rotates relative to the outer body 34, the toner is prevented from leaking out of the toner cartridge 30.

The gap between the arch 40B and the outer body 34, the thickness of the sealing member 45, and the thickness of the shutter 41 are related such that $$t3+t4+t5>h \quad \text{Eq. (1)}$$

$$h-(t3+t4)>t6 \quad \text{Eq. (2)}$$

where h is the gap between the arch 40B and the outer body 34, t3 is the thickness of the shutter 41, t4 is the height of the projection 41*b*, t5 is the thickness of the sealing member 45 when the sealing member 45 is not compressed, and t6 is the minimum thickness of the sealing member 45 when the sealing member 45 is compressed fully.

The aforementioned dimensional relations ensure that the shutter 41 is held at the closing position. Compressing the sealing member 45 allows the projection 41*b* to be smoothly disengaged from the recess 46 so that a guide 43 can guide the engagement portion. The engagement portion 42 may be formed at the projection 41*b*.

Third Embodiment

Figure 17:
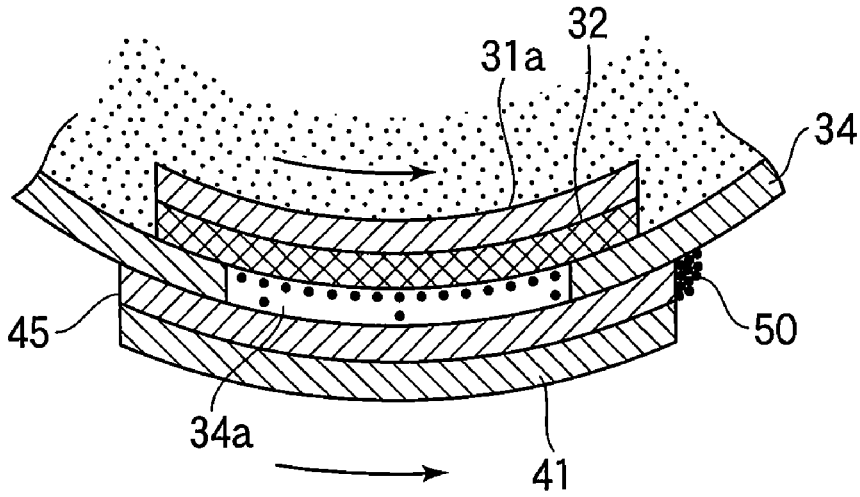
FIG. 17 is a fragmentary cross sectional view illustrating toner particles adhering to the resilient sealing member.
Figure 18:
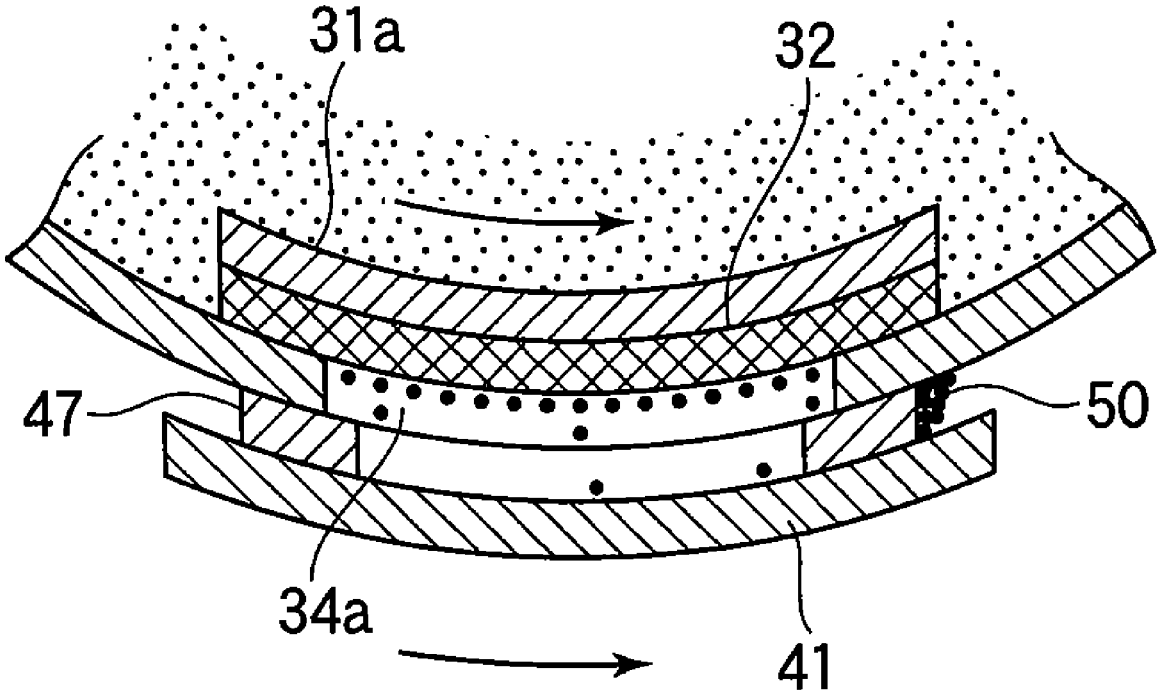
FIG. 18 is a fragmentary cross sectional view illustrating toner particles adhering to a resilient member in a third embodiment.

FIG. 17 is a fragmentary cross sectional view illustrating toner particles 50 adhering to the resilient sealing member 45 in the second embodiment. FIG. 18 is a fragmentary cross sectional view illustrating toner particles 50 adhering to a resilient member 47 in a third embodiment.

In the second embodiment, the sealing member 45 covers the entire inner the surface of the shutter 41 as shown in FIG. 17. Therefore, when the toner cartridge 30 is attached to the developing unit 20 or detached from the developing unit 20, the large area of the sealing member 45 slides on the circumferential outer surface of the cartridge 30. Therefore, when the guides 43*a* and 43*b* guide the engagement portion 42, a large pressing force or a large lifting force may be required.

When the shutter 41 is moved across the opening 34*a* from the opening position to the closing position before the toner cartridge 30 is dismounted from the developing unit 20 as shown in FIG. 18, the toner may adhere to edges of the shutter 41.

Figure 19:
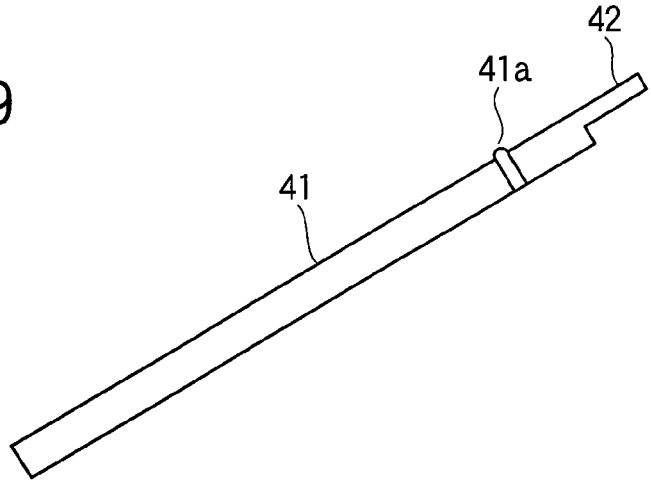
FIGS. 19-21 are perspective views of a shutter according to the third embodiment.
Figure 20:
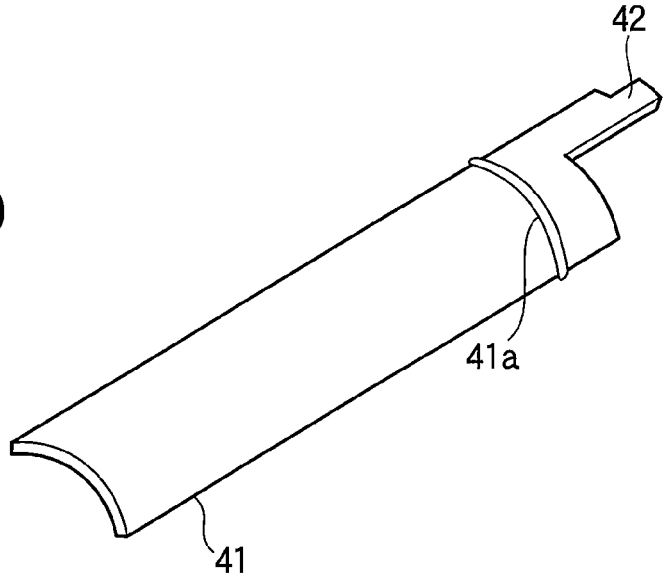
Figure 21:
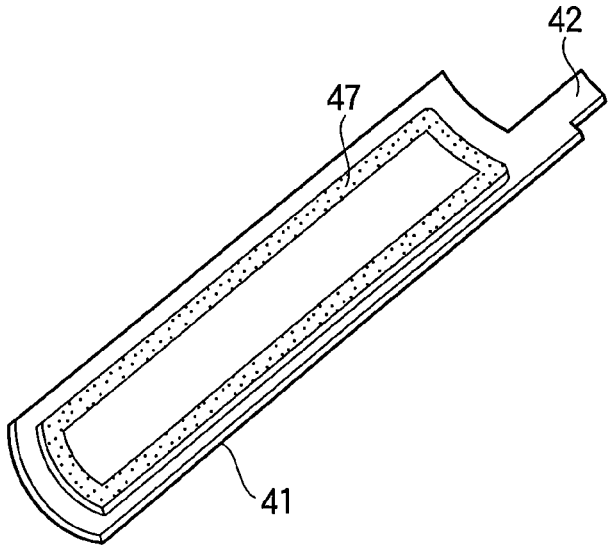

FIGS. 19-21 are perspective views of the shutter 41 according to the third embodiment. Referring to FIGS. 19-21, the sealing member 47 is fixed to the shutter 41, having a smaller length and a smaller width than the shutter 41. The sealing member 47 is in the shape of a rectangular ring in which a rectangular sheet material is punched through to form a rectangular hole in the sheet material.

The sealing member 47 has a smaller area in contact with the outer body 34 than the sealing member 45 according to the second embodiment. Thus, the sealing member 47 requires less force than the sealing member 45.

As shown in FIG. 18, the outer dimensions of the sealing member 47 smaller than those of the sealing member 45 are advantageous in that the shutter 41 extends further outward than the sealing member 47 to receive the toner particles that fall from the sealing member 47. In this manner, the toner particles are prevented form falling onto the surroundings.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A toner cartridge and a developing unit for use in an image forming apparatus, wherein the toner cartridge comprises:

a toner chamber holding toner therein and having a curved outer surface and an opening formed in the outer surface through which the toner is discharged from said toner chamber into the developing unit; and a dual shutter mechanism including an inner shutter and an outer shutter, said inner shutter being disposed in said toner chamber, said inner shutter being rotatable relative to said toner chamber to close and open the opening from inside of said toner chamber, said outer shutter having an engagement portion and being movably mounted to an outer surface of said toner chamber, said outer shutter being slidable either to a closing position where said outer shutter closes the opening and faces said inner shutter that closes the opening or to an opening position where said outer shutter opens the opening;

wherein the developing unit comprises:

a guide formed in the developing unit, wherein when the toner cartridge is moved into the developing unit, said guide engages the engagement portion to guide the engagement portion in such a way that the outer shutter moves relative to said toner chamber from the closing position to the opening position.

2. The toner cartridge and the developing unit according to claim 1, wherein the developing unit further comprises a first projection;

wherein said toner chamber includes a portion that defines a cutout;

wherein said inner shutter has a second projection that resiliently projects outward from said inner shutter, wherein when the second projection is received in the cutout, said inner shutter is positioned relative to said toner chamber such that said inner shutter closes the opening;

wherein when the toner cartridge has been mounted into the developing unit, the first projection portion pushes the second projection into said toner chamber to allow said inner shutter to rotate relative to said toner chamber.

3. The toner cartridge and the developing unit according to claim 1, wherein the developing unit is detachably mounted in the image forming apparatus.

4. A toner cartridge and a developing unit that are used in an image forming apparatus, wherein the toner cartridge comprises:

a toner chamber holding toner therein and having an opening through which the toner is discharged from said toner chamber into the developing unit;

an inner shutter disposed in said toner chamber, said inner shutter being rotatable relative to said toner chamber to close and open the opening from inside of said toner chamber; and an outer shutter having an engagement portion and movably mounted to an outer surface of said toner chamber, said outer shutter being movable either to a closing position where said outer shutter closes the opening or to an opening position where said outer shutter opens the opening;

wherein the developing unit comprises:

a guide groove formed in the developing unit, wherein when the toner cartridge is moved into the developing unit, said guide groove engages the engagement portion to guide the engagement portion in the guide groove in such a way that the outer shutter moves relative to said toner chamber from the closing position to the opening position;

wherein said inner shutter includes a first engagement portion and said outer shutter includes a second engagement portion;

wherein when said inner shutter is at the closing position, the first engagement portion engages the second engagement portion so that said inner shutter is locked to said outer shutter;

wherein when said inner shutter is at the opening position, the first engagement portion disengages from the second engagement portion so that said inner shutter is unlocked from said outer shutter.

5. The toner cartridge and the developing unit according to claim 1, wherein said outer shutter includes a sealing member formed of a resilient material and fixed to a surface of said outer shutter that faces said toner chamber.

6. The toner cartridge and the developing unit according to claim 5, wherein the sealing member is in a rectangular shape that extends within a perimeter of the surface of said outer shutter facing the outer surface of said toner chamber.

7. An image forming apparatus incorporating said toner cartridge and said developing unit according to claim 1.

8. The toner cartridge and the developing unit according to claim 1, wherein said guide engages the engagement portion to guide the engagement portion in such a way that the outer shutter moves in a path along the curved outer surface relative to said toner chamber from the closing position to the opening position.

* * * * *